United States Patent [19]

Mooney et al.

[11] 3,988,052

[45] Oct. 26, 1976

[54] GROUND CLAMP

[75] Inventors: Thomas Mooney, Mount Sinai, N.Y.; Richard A. Bauer, Etters, Pa.; Stephen Veselaski, Shirley, N.Y.

[73] Assignee: I-T-E Imperial Corporation, East Farmingdale, N.Y.

[22] Filed: June 30, 1975

[21] Appl. No.: 591,410

[52] U.S. Cl. ..... 339/265 R; 339/272 UC

[51] Int. Cl.[2] ..... H01R 7/08

[58] Field of Search ..... 339/14 R, 14 L, 243, 339/265 R, 265 F, 272 R, 272 UC

[56] References Cited

UNITED STATES PATENTS

| | | | |
|---|---|---|---|
| 2,533,897 | 12/1950 | Reddock | 339/265 F |
| 3,058,087 | 10/1962 | Piasecki | 339/265 F |
| 3,706,959 | 12/1972 | Norden | 339/14 R |

FOREIGN PATENTS OR APPLICATIONS

| | | | |
|---|---|---|---|
| 528,644 | 8/1956 | Canada | 339/265 R |

*Primary Examiner*—Joseph H. McGlynn
*Attorney, Agent, or Firm*—Howard C. Miskin

[57] ABSTRACT

An electrical conduit grounding device includes a clamp formed of a pair of similarly shaped screw connected clamp sections each formed of a web including a crowned medial section terminating in coplanar wings and provided with longitudinal flanges. One of the clamp sections is provided with a cable clamp at the crown apex and which is stamped and shaped from the web, leaving corresponding openings therein, and includes first and second laterally spaced vertical arms atop the crowned section, a longer arm terminating in a horizontal leg projecting toward and above the top of the other arm. The leg has a tapped vertical bore engaged by a cable clamping screw.

6 Claims, 3 Drawing Figures

GROUND CLAMP

BACKGROUND OF THE INVENTION

The present invention relates generally to improvements in an electrical connecting device and it relates more particularly to an improved electrical conduit grounding clamp.

It is a general practice in the distribution of electrical lines through conduit, whether of the rigid pipe type or of the flexible helix type, to connect the conduit to ground so that the conduit functions as a grounded conductor. The electrical conduit is commonly grounded by means of a clamp which tightly engages the conduit and is clamped or otherwise connected to a suitably grounded cable. The devices heretofore available and proposed for grounding the conduit, however, possess numerous drawbacks and disadvantages. They are usually unreliable over periods of time, and expensive devices, difficult to apply, of little versatility and adaptability and otherwise leave much to be desired.

SUMMARY OF THE INVENTION

It is therefore a principal object of the present invention to provide an improved electrical connector.

Another object of the present invention is to provide an improved device capable of being made of sheet metal stampings for connecting electrical conduit to ground.

Still another object of the present invention is to provide an improved electrical conduit grounding clamp device.

A further object of the present invention is to provide a device of the above nature characterized by its high reliability, ruggedness, low cost, simplicity, ease of fabrication and application and high versatility and adaptability.

In a sense the present invention contemplates the provision of an improved conduit grounding device comprising a pair of first and second conduit clamp members which are relatively movable between an open conduit release and a closed conduit clamping position, said first clamp member including a laterally extending web having stamped therefrom to leave a corresponding first opening therein an outwardly extending first leg terminating in a raised laterally projecting arm overlying a predetermined portion of the web and having a tapped vertical bore therein, and a screw engaging said tapped bore and adapted to clamp a cable between screw and the predetermined web portion.

According to the preferred form of the improved conduit grounding device, the first clamp member web includes a medial raised or crown section and opposite coplanar wing section, the first leg and arm being stamped from the web along a side portion of the crown section and the adjacent wing and a second upwardly directed leg being stamped from the web along an opposite side of the crown section. The second clamp member is similar in shape to the first clamp member, but lacks the cable engaging formation. The two clamp members are screw connected back to back and the webs are provided with vertical flanges along opposite longitudinal edges. The improved conduit grounding clamp is of utmost simplicity and low cost, rugged and highly reliable, easy to apply and of great versatility and adaptability and is characterized by being produced by conventional stamping and forming procedures.

DESCRIPTION OF THE PREFERRED EMBODIMENT

Figure 1:
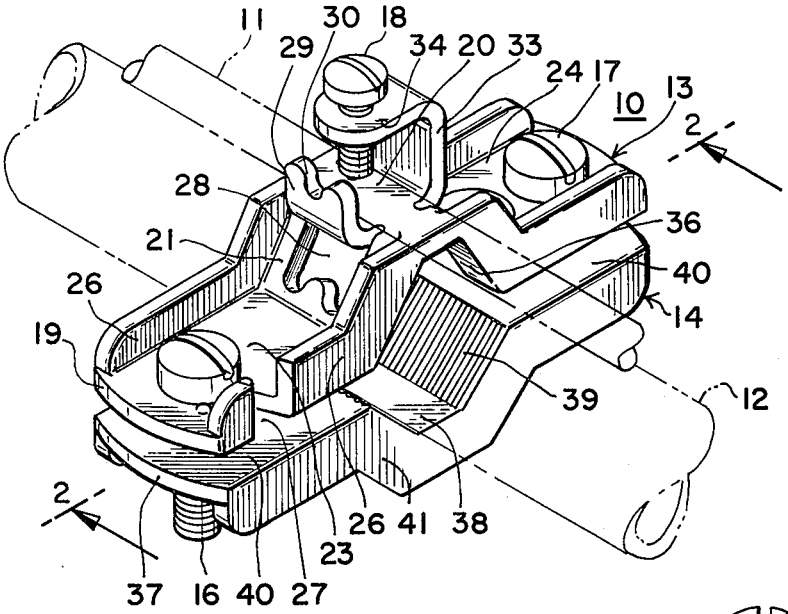
FIG. 1 is a front perspective view of a preferred embodiment of the present invention shown in closed clamped position on a conduit and ground cable illustrated by broken line.
Figure 2:
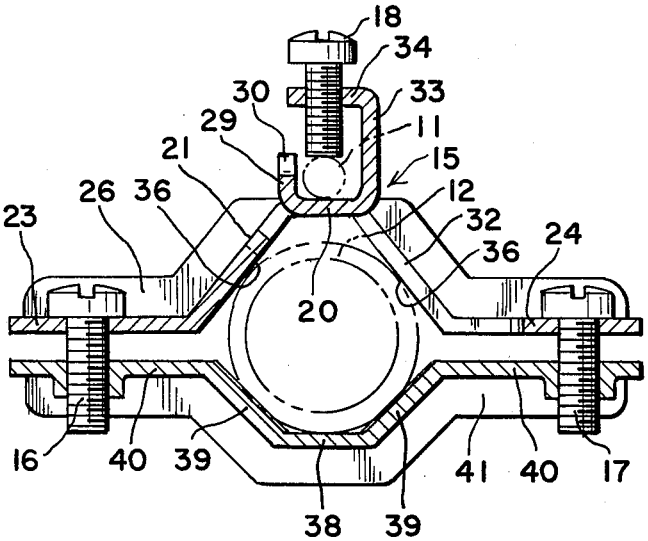
FIG. 2 is a sectional view taken along line 2—2 in FIG. 1.
Figure 3:
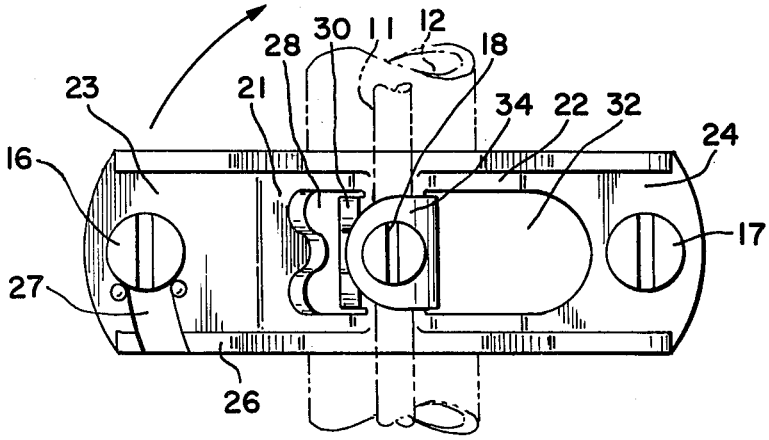
FIG. 3 is a top plan view thereof.

Referring now to the drawings which illustrate a preferred embodiment of the present invention, the reference numeral 10 generally designates the improved electrical conduit grounding clamp device illustrated as applied to an uncovered grounded cable or electrical conductor 11 and an electrical line carrying conduit 12 to effect a firm low resistance connection between the cable 11 and conduit 12. The ground clamp 10 consists of a pair of complementary upper and lower cooperating first and second clamp members 13 and 14 respectively, a pair of clamp members connecting screws 16 and 17 and a ground cable clamping screw 18.

The first clamp member 13 is formed by stamping and includes a longitudinally extending flat web 19 shaped to provide a medial crown portion, generally indicated at 15, having a horizontal flat top section 20 and side sections 21 and 22 oppositely diverging downwardly from the opposite side edges of top section 20, the side sections 21 and 22 terminating at their bottom edges in horizontal coplanar wings 23 and 24. Upwardly directed vertical flanges 26 are formed along the longitudinal edges of the web 19, the tops of the flanges 26 adjacent to the top section 20 being coplanar therewith. The wing 24 has a bore formed therein engaged by the screw 17. The wing 23 has a bore formed therein engaged by screw 16, which bore meets a transversely extending arcuate slot 27 extending to the edge of web 19 through the corresponding flange 26.

Formed from the side section 21 and leaving a correspondingly shaped opening 28 therein is a relatively short upwardly projecting vertical leg 29 joined to the crown top 20 by a rounded edge end having a saddle shaped top edge 30. Further, formed from the side section 22 and wing 24 and leaving a corresponding shaped opening 32 therein is a relatively long upwardly projecting vertical leg 33 joined to the crown top 20 by a rounded edge opposite the junction thereof with leg 29. A horizontal lug or arm 34 projects toward leg 29 from the top edge of leg 33 and is joined thereto by a curved edge and is above the level of the top edge 30 of leg 29 and overlies the crown top section 20. The arm 34 has a tapped vertical bore engaged by the cable clamping screw 18. The confronting edges of arm 29 and leg 34 are spaced apart a distance somewhat greater than the diameter of the grounding cable 11. The inside faces 36 of crown side sections 21 and 22 are longitudinally serrated.

The lower or second clamp member 14 is generally of the same overall configuration as the first clamp member 13 and includes a longitudinal web 37 shaped to provide a medial horizontal bottom section 38 forming the crown portion from the opposite side edges of which extend upwardly diverging side sections 39 having serrated inside faces. The side sections 39 terminate in coplanar oppositely extending horizontal wings 40.

Longitudinally extending depending vertical flanges 41 are formed along the longitudinal edges of the web 37.

The wings 23 and 24 are parallel to and overlie respective wings 40 and the concave faces of the crowns 20 and 38 confront each other. The clamp members 13 and 14 are retained in assembled adjustable pivoted position by the screw 17 which rotatably engages a bore in wing 24 and engages an aligned tapped bore in the underlying wing 40. The screw 16 slidably registers with slot 27 and engages a tapped bore in the wing 40 underlying the wing 23. The clamp members 13 and 14 are thus relatively swingable about the shank of screw 17 with the shank of screw 16 sliding in the slot 27 and the vertical spacing between the clamp members 13 and 14 are adjustable by the screws 16 and 17.

In applying the grounding device 10 to the conduit 12 and grounding cable 11, the screws 16 and 17 are loosened and the clamp members are relatively swung about screw 17 to an open position separating the screw 16 from the slot 27. The open clamp device 10 is applied to the conduit 12 and swung to a closed position with the screw 16 disposed at the inner end of the slot 27 and the conduit embraced by the clamp member crown sections. The screws 16 and 17 are then tightened to firmly clamp the conduit 12 between the clamp members 13 and 14 with the serrated faces 39 and 40 biting into the surface of the conduit 12. The screw 18 is turned to its raised position and the grounding cable 11 is advanced between the confronting edges leg 29 and arm 34 to a position between the end of screw 18 and the crown top section 20 and the screw 18 is then tightened to tightly engage and clamp the cable 11 between the screw 18 and the crown top section 20.

Flanges 26 and 41 provide strength to the clamp members 13 and 14 to tightly clamp the conduit. Further, the side opening between the confronting edges of leg 29 and arm 34 allows a single ground wire to readily connect a series of ground clamps 10 without the difficulty of snaking the wire through each opening sequentially.

While there has been described and illustrated, a preferred embodiment of the present invention, it is apparent that numerous alterations, omissions and additions may be made without departing from the spirit thereof.

What is claimed is:

1. A conduit grounding device comprising a pair of first and second conduit clamp members relatively movable between an open conduit release and a closed conduit clamping position and delineating a clamp engaging longitudinal passageway, said first clamp member including a laterally extending web having stamped therefrom to leave a corresponding first opening therein, an outwardly extending first leg terminating in a raised laterally projecting arm directly overlying a predetermined portion of said web and having a tapped vertically extending bore therein and said first clamp member laterally extending web having stamped therefrom to leave a corresponding second opening therein laterally spaced from said first opening an outwardly extending second leg having a free end transversely spaced from the free end of said arm, and a screw engaging said tapped bore and adapted to clamp a cable between said screw and said predetermined web portion, said first and second legs and said arm delineating a second longitudinal passageway and the proximate edges of said arm and second leg delineating a lateral passageway into said second longitudinal passageway.

2. The conduit grounding device of claim 1 wherein said web includes upwardly converging laterally spaced side sections and a horizontally extending top section extending between the upper ends of said side sections, said first and second openings being formed in said side sections.

3. The conduit grounding device of claim 2 wherein said top section faces and is spaced from said bore in said projecting arm.

4. The conduit grounding device of claim 2 including coplanar laterally outwardly projecting wings extending from the lower edges of said web side sections.

5. The conduit grounding device of claim 4 including vertically projecting flanges formed along the longitudinal edges of said web side sections and wings.

6. The conduit grounding device of claim 4 wherein said second clamp member comprises a web including downwardly converging laterally spaced side sections, a horizontally extending top section extending between the bottom ends of said second clamp side sections and terminating in horizontal coplanar wings confronting the underfaces of said first clamp member wings and comprising screws extending between and engaging the wings of respective confronting pairs thereof.

* * * * *